United States Patent [19]

Kitazawa

[11] Patent Number: 4,543,870

[45] Date of Patent: Oct. 1, 1985

[54] DRUM FOR MUSIC BOX

[75] Inventor: Yasuhide Kitazawa, Nagano, Japan

[73] Assignee: Kabushiki Kaisha Sankyo Seiki Seisakusho, Nagano, Japan

[21] Appl. No.: 594,264

[22] Filed: Feb. 27, 1984

[51] Int. Cl.[4] ..... G10F 1/06

[52] U.S. Cl. ..... 84/96

[58] Field of Search ..... 84/96, 95 R, 94

[56] References Cited

FOREIGN PATENT DOCUMENTS 259036 6/1949 Switzerland ..... 84/96

*Primary Examiner*—L. T. Hix

*Assistant Examiner*—Brian W. Brown

*Attorney, Agent, or Firm*—Sughrue, Mion, Zinn, Macpeak and Seas

[57] ABSTRACT

A drum for a music box comprises a plate having a number of pins on its outer surface and a number of holes in its backface. The plate is bent to form a cylinder. The pins and holes are arranged in a coaxial fashion with each other. Each of the pins has a substantially uniform diameter from its distal end to proximal end. A depth of the holes is smaller than a thickness of the plate and is greater than half the thickness of the plate and is greater than half the thickness of the plate. A diameter of the pins is smaller than the diameter of the holes and is greater than half the diameter of the holes. The drum is preferably formed through a fine blanking method. Thus, the drum is suitable for mass-production in low cost with a high performance.

12 Claims, 14 Drawing Figures

DRUM FOR MUSIC BOX

BACKGROUND OF THE INVENTION

The present invention relates to a drum or barrel suitable for use in the high-grade music boxes.

Because high-grade music boxes are constructed so that the internal structure can be seen from the outside, it is required that the internal structure be excellent in design. Also, to produce a graceful tune by using a chord and to allow playing of a plurality of musics by shifting the drum in the axial direction, it is necessary that pins distributed on the peripheral surface of the drum be slender in the order of 0.3–0.4 mm in diameter and the number of pins per unit area on the drum periphery be increased.

A conventional drum of a high-grade music box is produced through processes of drilling fine holes in a pipe made of brass and the like treated to bear an excellent aesthetic appearance, implanting the pins into the holes one by one, and filling up the pipe with rosin for purpose of reinforcing the pins and increasing the weight of the drum. Therefore, the conventional drum of the high-grade music box has the drawback that the process of implanting the pins is time-consuming, is inferior in work efficiency, and requires a high degree of skill. In addition, faults will be caused in final products.

On the other hand, another type of the drum for use in an ordinary music box is produced by pressing a flat plate to form pin-like projections and then bending the plate into a cylindrical shape. This makes it possible to ensure a mass-productivity and a desirable quality of the products. However, in such a conventional drum produced by the stamping, because the size of the pin is in the order of 0.6 mm in diameter at best and the proximal end of each pin is larger in size due to a removing work of a metal mold, the number of pins per unit area cannot be increased. Furthermore, in case that the switching of musics is achieved through movement of the drum, the length in the axial direction of the drum is elongated and the distance of movement in the axial direction of the drum must be increased, causing a problem in practice. Also, because the proximal end of each pin is larger in size as described above, if the pins are ground so that respective distal ends of the pins are included by one common cylindrical surface, the pin's length and diameter at the tip are varied over a number of pins and a desired timing of sound generation for a chord is not obtained; thus, this type of drum is not suitable for music boxes having a number of pins and reeds. Moreover, at the time of shaping the plate into the cylinder after the stamping, elongations in the axial direction and in the circumferential direction present, so that a positional precision of the pins cannot be obtained and a discrepancy occurs between the pin and a corresponding vibration reed, thus, this type of drum is also unsuited to the high-grade music box.

Furthermore, if the plate with a number of pins formed thereon by the stamping is shaped into the cylinder by use of a method similar to the conventional method, the elongations take place in the axial and circumferential directions. Specifically, the amount of elongation in the circumferential direction differs between the end portions and the midway portion of the plate and because end plates are pressed against the both ends of the cylinder after the cylindrical shape is completed, the midway portion expands in the radial direction and a gap appears at the midway portion. FIGS. 4 and 5 show the state of occurrence of the foregoing gap. As shown in FIG. 4, a flat rectangular plate material 1 which is produced by punching a plate into a configulation surrounded by four straight sides is formed with a large number of pins 2 through the pressing and, as shown in FIG. 5, this rectangular plate material 1 is shaped into a cylinder with its outer peripheral surface having the pins thereon. In this process, a gap 10 presents, as described above, at a midway portion of butting margins of the cylinder. If this type of drum is to be employed in the high-grade music box, the remaining of the gap 10 poses a serious problem in producing the high-grade music box because in general the whole internal mechanism of the high-grade music box is observable from the outside and has to be seen beautiful. In addition, if rosin or resin is filled within the drum and is solidified in order to enhance the tone quality, rosin and the like would flow out through the gap 10 in case it exists. Incidentally, in the experiment with the drum which was 95 mm long in the axial direction, there resulted in the gap 10 of 0.2 mm or so.

SUMMARY OF THE INVENTION

It is a primary object of the invention to provide a drum for the music box whose pins are formed through the plastic working with a high working efficiency. The thickness of each pin can be made uniform and thin from a distal end to a proximal end. The elongation in the axial direction in shaping the plate into the cylinder is small, and the precision in butting against vibration reeds can be enhanced.

It is another object of the invention to provide a drum for the music box which has no gap at a midway portion of the butting marginal portion that would appear when the plate having the pins thereon is shaped into the cylinder.

DESCRIPTION OF THE PREFERRED EMBODIMENTS

This invention will be described with reference to the drawings.

Figure 1A:
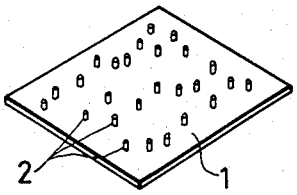
FIGS. 1(*a*)–(*e*) are perspective views showing an example of the manufacturing steps of the drum for the music box according to the invention.
Figure 1B:
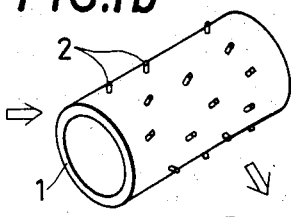
Figure 1C:
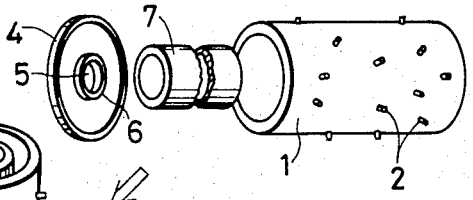
Figure 1E:
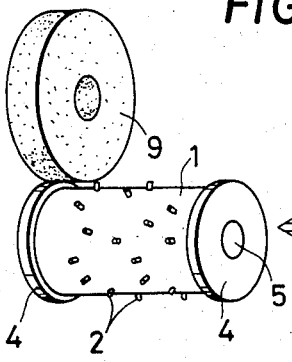
Figure 1D:
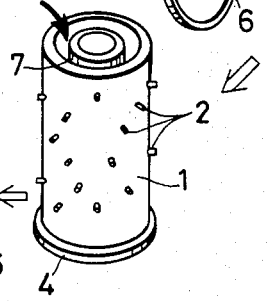
Figure 2:
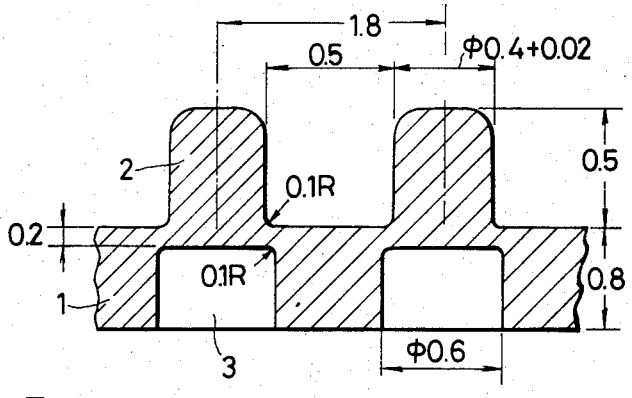
FIG. 2 is an enlarged sectional view showing pins formed in accordance with the invention.
Figure 3:
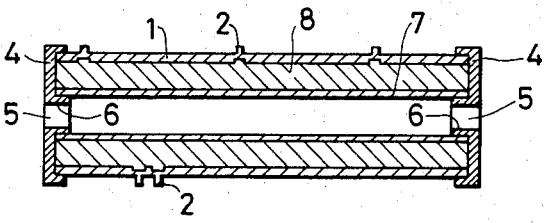
FIG. 3 is an overall sectional view of the drum having the pins shown in FIG. 2.
Figure 4:
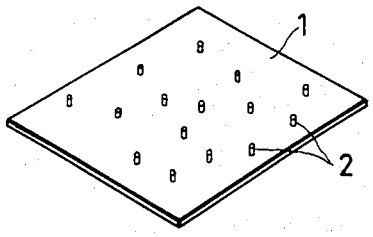
FIG. 4 PRIOR ART
FIG. 4 is a perspective view showing an example of a plate material for use in the drum of the conventional music box.
Figure 5:
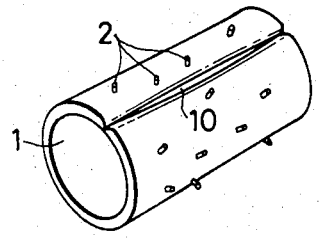
FIG. 5 PRIOR ART
FIG. 5 is a perspective view showing the cylinder shaped from the plate shown in FIG. 4.

FIG. 1 shows an example of the manufacturing steps to produce the drum according to the invention and the feature of the invention resides particularly in the first step, i.e., the stamping step. In the stamping step as shown in FIG. 1(*a*), a roof material made of an iron plate 1 of, for example, 0.8 mm in thickness is employed, pins 2 to flip vibration reeds (not shown) of the music box are formed through the stamping, and at the same time, a blank punch-out process is performed. As shown in FIG. 2, in producing the pins 2, in the backface of iron plate 1 are formed holes 3 having a depth smaller than the thickness of iron plate 1 and greater than the half of the plate thickness, and on the outer face of iron plate 1 pins 2 are formed substantially coaxially with the holes 3. The pins 2 are shaped so that each pin is smaller than the diameter of holes 3, larger than half the diameter of holes 3, and substantially uniform in thickness from the distal end to the proximal end. This formation step of the pins is achieved preferably through the plastic working, particularly, a fine blanking process well known per se. Example of the shaping process of the pins 2 by the use of the fine blanking will be described. The respective dimensions of the pins, holes and plate are preferably in the following ranges:

| | |
|---|---|
| Plate Thickness | 0.7–1.0 mm |
| Pin Height | 0.5–0.6 mm |
| Pin Diameter | 0.37–0.45 mm |
| Hole Diameter | 0.45–0.6 mm |
| Hole Depth | 0.6–0.75 mm |

Incidentally, the height of pins is to be about 0.4 mm after the grinding process is applied thereto.

More specific Examples will be described in accordance with the present invention.

| | Example | | | | | | |
|---|---|---|---|---|---|---|---|
| | 1 | 2 | 3 | 4 | 5 | 6 | 7 |
| Pin Height | 0.6 | 0.6 | 0.6 | 0.5 | 0.6 | 0.7 | 0.55 |
| Pin Diameter | 0.4 | 0.45 | 0.38 | 0.37 | 0.43 | 0.45 | 0.38 |
| Hole Diameter | 0.5 | 0.55 | 0.45 | 0.6 | 0.45 | 0.55 | 0.48 |
| Hole Depth | 0.65 | 0.6 | 0.7 | 0.5 | 0.7 | 0.75 | 0.6 |
| Plate Thickness | 0.8 | 0.8 | 0.8 | 0.8 | 0.8 | 1.0 | 0.7 |
| Unit: all in mm. | | | | | | | |

In the above described Examples, the plate was 91.5 mm long in the axial direction and was 77.8 mm in the circumferential direction, and the pins were ground to have a height of 0.4 mm. The pins and holes were formed through the fine blanking method.

In view of the Examples, according to the present invention, it is preferable that De/Tp be in the range of 0.6 to 0.9, more preferably, in the range of 0.75 to 0.875 where De denotes the depth of the holes and Tp denotes the thickness of the plate, and it is preferable that Dp/Dh be in the range of 0.6 to 0.96, more preferably, in the range of 0.79 to 0.85 where Dp denotes the diameter of the pins and Dh denotes the diameter of the holes. It should be noted that the thickness of the plate in Example 6 was large to enhance sound quality and the thickness of the plate in Example 7 was small to reduce a manufacturing cost. In the latter case, a bending or curling operation might readily be attained.

As shown in FIG. 1(*b*), the iron plate 1 having the pins formed in the manner described above is formed into a cylinder by butting together the both ends of the iron plate 1. Then, as shown in FIG. 1(*c*), an end plate 4 is press-fitted into and secured to one end of the cylinder. End plate 4 has formed with a shaft hole 5, the marginal portion of shaft hole 5 serves as a flange portion 6, and one end of a pipe shaft 7 is press-fitted into and secured to the flange portion 6. Then, as shown in FIGS. 1(*d*) and 3, between the cylindrical iron plate 1 and the pipe shaft 7, rosin or resin 8 is filled to increase the weight of the drum. Another end plate 4 is press-fitted and secured to the other end of the cylindrical plate 1. The other end of the pipe shaft 7 is press-fitted and secured to the flange portion 6 of another end plate 4. Then, as shown in FIG. 1(*e*), the tip of each pin 2 is ground by a grinder 9 so that the tip face of each pin 2 is positioned on the same cylindrical surface. In this way, the drum for the music box has been completed. As the resin, epoxy-origin resin can be employed, for example.

Figure 9:
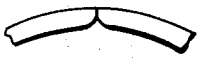
FIG. 9 is a side view showing a portion of the end finishing of the cylinder shown in FIG. 8.

As apparent from the foregoing embodiment, by the steps of forming the pins through the fine blanking process and shaping the plate into the cylinder, there can be obtained the drum equivalent in property to the conventional drum for the high-grade music box manufactured by implanting pins in a pipe. The drum has a feature that no elongation of the iron plate appears, respective sounds composing a chord are emitted simultaneously even though the pins were ground to make uniform their height because the size of the pin is substantially uniform from tip to root, the pins can be positioned close together because the diameter of the hole in the backface of the iron plate is not larger than twice the pin's diameter, and the external view is excellent because the proximal end of the pin has no appreciable swelling and the drum surface except for the pins is finished smoothly. Furthermore, by use of the fine blanking process, the outer side of the butting margin bears a sharp edge, as shown in FIG. 9, and good appearance is obtained.

Next, another aspect of the present invention will be described with reference to FIGS. 7 through 10.

Figure 7:
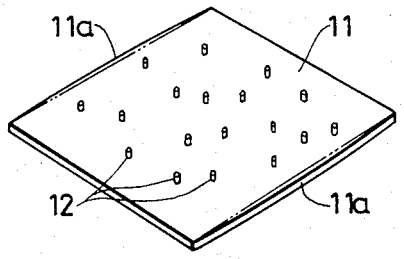
FIG. 7 is a perspective view showing an example of a plate material for use in the drum of the music box according to this invention.
Figure 8:
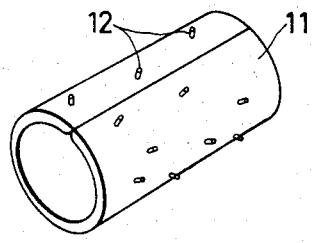
FIG. 8 is a perspective view showing the cylinder shaped from the plate shown in FIG. 7.

In FIG. 7, a flat plate material 11 formed with a number of pins 12 which flip the vibration reeds to cause sound generation has such a configuration that two sides 11*a*, 11*a* to be butted together in forming the cylinder are provided with loose arcs with the midway portion expanding. When the thus configured plate material 11 is shaped into the cylinder in such a manner that the face with the pins may assume the outer surface, even though the elongation in the circumferential direction differs between the end portions and the midway portion of the plate or the midway portion expands in the radial direction as a result of holding the both end portions of the cylinder by the end plates, the resulting cylinder has no gap between the butting margins of two sides 11*a*, 11*a* of the plate material 11 and the butting margins form generally a straight line, as shown in FIG. 8. The reason of this is that the elongation and expansion are cancelled by means of two sides 11*a*, 11*a* of the plate material 11 having been previously shaped so that the midway portion has an expansion.

Figure 10:
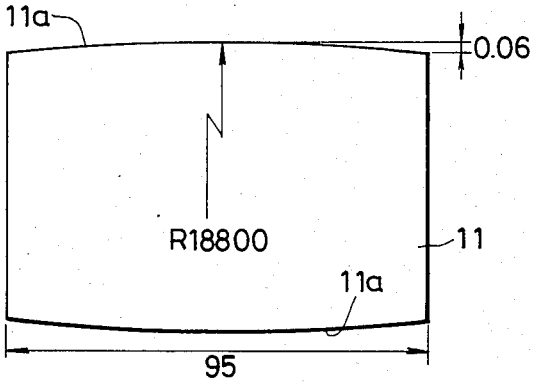
FIG. 10 is a plane view showin an example of the plate material for use in the drum of the music box according to the invention.

FIG. 10 shows an example of the plate material 11 employable in this invention, in which the length in the axial direction is 95 mm, and two sides 11*a*, 11*a* to be butted at the time of forming the cylinder were outlined by an arc of 18,800 mm in radius with the expansion of the midway portion being 0.06 mm. As a result, upon shaping the cylinder by use of a method similar to the conventional shaping process, a gap was prevented from appearing at a midway of the butting portion.

In this way, according to the invention, the formation of the gap at the butting portion at the time of forming the cylinder is prevented and the drum is finished with anaesthetic appearance. The invention can provide the drum bearable enjoyment even though it is employed in the high-grade music box whose inside is visible from the outside. Also, rosin and the like do not flow out even though the drum is filled up with the same, whereby the drum can be employed in the high-grade music box with a high quality of sound. Furthermore, the mechanical strength is increased and the number of resonances is reduced because of no formation of the gap at the butting portion. No deformation occurs in the finishing of the distal end of each pin, for example, the grinding process. The cylindrical shape is maintained stably.

In general, it is difficult to eliminate completely the gap at the butting portion. However, the intended object of this invention can be accomplished if the gap be smaller than 0.1 mm.

Figure 6:
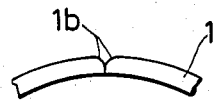
FIG. 6 is a side view showing a portion of an end finishing of the cylinder shown in FIG. 5.

In the prior art, the blank punch-out process for the plate material 1 and the formation of the pins 2 were performed through the stamping process. For this reason, as shown in FIG. 6, an edge portion 1*b* on the outer surface side at the butting portion of the formed cylinder is rounded outwardly and a groove appears on the outer surface at the butting portion, this being undesirable for an external view. However, by substituting the plastic working, such as the fine blanking, for the blank punching-out of the plate material and the formation of pins, as shown in FIG. 9, the edge portions on the sides of the outer surfaces at the butting portion of the formed cylinder are aligned with each other, and the surface of the butting portion is finished well, whereby the drum having a much better external view can be provided.

The expansion of the two sides being butted mutually of the plate material is not necessarily to be given by the arc configuration, a different expansion given by a trapezoidal shape may be used if desired.

The invention as specified in the appended claims renders the following effects.

(1) Since the drum is manufactured by plastic-working the plate to form the pins and shaping the plate into a cylinder, a productivity is excellent and the size accuracy of high degree can be obtained.

(2) Since the thickness of the pin is substantially uniform from the distal end to the proximal end, a chord is also generated well.

(3) Since the pins are hardened by the plastic working, no hardening treatment is required.

(4) Since no swelling appears on the drum surface at the pin's proximal end, for example, there results in an aligned surface.

(5) Through mass-production the drum of stable quality for the high-grade music box can be provided at a low cost.

(6) By the use of the fine blanking process, the edge on the outer surface at the butting portion of the cylinder becomes sharp, thereby providing fine lines.

(7) Since no gap appears at the butting portion of the cylinder, the external view is excellent and a filling substance does not flow out.

(8) Since no gap appears at the butting portion of the cylinder, the mechanical strength of the drum is high.

I claim:

1. A drum for a music box comprising a plate having a number of pins on its outer surface, said plate being shaped into a cylinder, and a number of holes corresponding to said number of pins, said pins each having a substantially uniform diameter from a distal end to a proximal end of the pin, said holes each having a depth (De) which is smaller than a thickness of said plate and is greater than half the thickness (Tp) of said plate, said holes being formed in a backface of said plate, said pins each having the diameter (Dp) which is smaller than a diameter (Dh) of said holes and is greater than half the diameter (Dh) of said holes, said pins being formed on the outer face of said plate substantially coaxially with the associated holes, and both ends of said plate being butted together to form the cylinder;

wherein:

$Tp > Dh$ and

Dp is kept substantially constant.

2. The drum of claim 1 wherein said pins are formed by a fine blanking process.

3. The drum of claim 1 wherein end plates are press-fitted to the both ends of the drum.

4. The drum of claim 1 wherein the drum is filled with a resin.

5. The drum of claim 1 wherein at least one of sides, to be butted in forming the cylinder, of said plate is expanded at its midway portion in a butting direction.

6. The drum of claim 2 wherein at least one of sides, to be butted in forming the cylinder, of said plate is expanded at its midway portion in a butting direction.

7. The drum of claim 1, the ratio De/Tp is in the range of 0.6 to 0.9.

8. The drum of claim 7, the ratio De/Tp is in the range of 0.75 to 0.875.

9. The drum of claim 1, the ratio Dp/Dh is in the range of 0.6 to 0.96.

10. The drum of claim 9, the ratio Dp/Dh is in the range of 0.79 to 0.85.

11. The drum of claim 1 wherein: $0.6Tp > Dp > 0.4Tp$.

12. The drum of claim 1 wherein: Dp is approximately equal to Tp/2.

* * * * *

UNITED STATES PATENT AND TRADEMARK OFFICE

CERTIFICATE OF CORRECTION

PATENT NO. : 4,543,870

DATED : October 1, 1985

INVENTOR(S) : Yasuhide KITAZAWA

It is certified that error appears in the above-identified patent and that said Letters Patent is hereby corrected as shown below:

On the title page, "Application No. 594,264" to read --Application No. 584,264--.

Signed and Sealed this

*Twenty-first* Day of *January 1986*

[SEAL]

*Attest:*

DONALD J. QUIGG

*Attesting Officer*

*Commissioner of Patents and Trademarks*